United States Patent [19]

Darbonne et al.

[11] 4,432,148

[45] Feb. 21, 1984

[54] CONTINUOUSLY OPERATING HYDRO-EXTRACTOR

[76] Inventors: Luc Darbonne, Le Prieure, Oncy sur Ecole; Hubert Darbonne, Chemin de Peronne, Oncy sur Ecole, both of 91490 Milly, France

[21] Appl. No.: 311,262

[22] Filed: Oct. 14, 1981

[30] Foreign Application Priority Data

Mar. 31, 1981 [FR] France ..... 81 06427

[51] Int. Cl.[3] ..... F26B 11/04

[52] U.S. Cl. ..... 34/58; 34/8; 34/126

[58] Field of Search ..... 34/8, 58, 126, 236; 233/7

[56] References Cited

U.S. PATENT DOCUMENTS 1,564,665 12/1925 Gates ..... 233/7
3,313,034 4/1967 Meyer ..... 34/58

FOREIGN PATENT DOCUMENTS 405373 11/1924 Fed. Rep. of Germany .
1057268 10/1953 France .
1571581 5/1969 France .

*Primary Examiner*—Larry I. Schwartz
*Attorney, Agent, or Firm*—Young & Thompson

[57] ABSTRACT

The present invention relates to hydro-extractors used for extracting water or other liquids mixed with a treated material. The hydro-extractor according to the invention comprises, in addition to the perforated wall of revolution 1 driven in rotation about its axis, material advancing members 4–6 acting on the material layer, the path of travel f of the advancing members in the region where said members cooperate with the layer m of treated material forcibly applied against the perforated wall 1 comprising a component $f_p$ in the diametral plane and an axial component fl directed downstream. The invention provides a hydro-extractor operating continuously, the dried product circulating in the direction of arrow D.

10 Claims, 6 Drawing Figures

CONTINUOUSLY OPERATING HYDRO-EXTRACTOR

The present invention relates to a continuously operating hydro-extractor, or spin-drier, that is a hydro-extractor comprising a perforated wall of revolution driven in rotation about its axis, the flow of product to be spin dried flowing in the axial direction of the hydro-extractor.

The known hydro-extractors operate generally with successive batches, viz. a volume of material to be spin dried being discharged in the hydro-extractor vat or drum, of generally vertical axis, and being removed therefrom after processing. Hydro-extractors, ovens or the like are already known which comprise a wall of revolution driven in rotation about its axis and operating continuously, the flow of product to be dried being driven along the axial direction of the apparatus. In such apparatus, the axial displacement is obtained simply by the flow by gravity when the axis is tilted, by helical screws or fixed oblique walls which slide the material on the cylindrical wall or via helical wings rigidly connected to the wall, which drive the material by lifting it along the peripheral wall in order to slide it by gravity in the downstream direction.

In the hydro-extractors, the material treated is subjected to a centrifugal force which is far greater than the force of gravity, which applies it forcibly against the wall and the natural progression by gravity cannot be used to drive the material. For the same reason, deflectors, endless screws of axis parallel to the drum axis, or fixed oblique walls cannot be used since, by virtue of the centrifugal force, the friction force on the perforated wall would be too great, the material would be forced against the deflectors and could be damaged.

The object of the invention is to provide, in spite of the above difficulties, a continuously operating hydro-extractor wherein the material progresses from the inlet toward the outlet without being subjected to intense mechanical stresses.

According to the invention, the hydro-extractor combines, together with the perforated wall of revolution driven in rotation about its axis, feeding or advancing members acting on the layer of material, the path of travel of the advancing members in the portion where said members cooperate with the treated layer of material applied against the perforated wall comprising a component in the diametral plane and an axial component directed downstream.

In this embodiment of the hydro-extractor, the material is driven, in the region of action of the advancing members, over a distance relatively short in the downstream direction, but, due to the component in the diametral plane which can be substantially equal to the peripheral speed of the perforated wall, and therefore of the material layer, ther can be no forcing.

According to a practical embodiment, the advance members are made of radial elements rigidly connected to a shaft rotatably mounted obliquely inside the inner volume defined by the wall of revolution, the length of each radial element being slightly less than the smallest distance from the shaft to the perforated wall.

The shaft carrying the advancing members could be mounted free in rotation, the rotation being provided by the thrust exerted on the advancing members by the material to be spin dried; however, it is preferable to positively drive the shaft in rotation, the rotation direction and the speed of the shaft being such that, in the portion of their circular path of travel where they are adjacent the wall, the edges of the radial elements move downstream, their peripheral speed being substantially to or preferably slightly higher than the peripheral speed of the inner surface of the perforated wall.

According to another embodiment, the advancing members are made of elements mounted free in rotation about stub-shafts rigidly connected for forming a staggered shaft, the general axis of the shaft being parallel to the drum generatrix. This allows using elements having an identical radial length and extending the length of the hydro-extractor drum.

The hydro-extractor can have indifferently an axis which is horizontal, vertical or oblique. The perforated wall can be cylindrical, frustoconical or of any other directrix shape, as a broken or curvilinear line providing it with a frustoconical-cylindrical general shape, or in the shape of a spool, a drum or the like. In the case of a frustoconical or frustoconical-cylindrical shape, the drum can be converging or diverging from upstream to downstream.

When the shaft is oblique, its two ends are preferably each at a distance from the perforated wall which is proportional to the radius of said perforated wall in the corresponding diametral plane and the downstream end is off-set upstream relative to the rotation direction of the perforated wall. However, when it is desired to subject the material to a stretching operation, or to a carding, the downstream end of the shaft can be at a distance from the perforated wall proportionally greater than that of the upstream end.

The longitudinal spacing of neighbouring radial elements has to be the smaller, the less their axis of rotation is tilted, the smaller is the arc in which the radial elements cooperate with the material mass , viz. the closer is the axis of rotation to the wall, and the greater is the angular spacing of neighbouring radial elements. The radial elements can be arranged in the shape of radial sheets, eventually provided by discs, spokes having a more or less high resiliency, masses such as brushes or foam rollers, endless screws or radial longitudinal sheets such as continuous walls, pallets or rakes.

The angle formed by the axis of rotation of the advancing member with the hydro-extractor drum axis is a function of the product to be treated and of its mechanical characteristics as well as the desired flow. The greater said angle is, the higher the axial component of the peripheral speed of the advance member relative to the diametral component is, but the peripheral speed of the radial elements of the advancement member will vary within a wide range if they are rigidly connected to the same shaft. Due to the increase of the axial component, the flow of the material will be increased. The hydro-extractor capacity, for a given drying speed, can be also increased by increasing the number of advancing members acting on the inner periphery of the drum. It is also possible to increase the rotation speed of the machine, but this is not always possible from the mechanical point of view or due to the mechanical resistance of the material treated.

The hydro-extractor according to the invention can be used for drying continuously practically all mineral, animal or vegetable materials, and used in particular for the pretreatment of materials which have to be subjected to a dessication by lyophilization, heating, etc. The mechanical drying is an energy-saving means for extracting unfixed water such as wash-water, etc. More-over, in the hydro-extractor according to the invention, the material layer is stirred by the advancing members moving through it, thereby enhancing still more the elimination of water relative to standard drying.

The invention will become more apparent from the reading of the description of various embodiments of the hydro-extractor according to the invention, with reference to the accompanying schematic drawings wherein.

Figure 1:
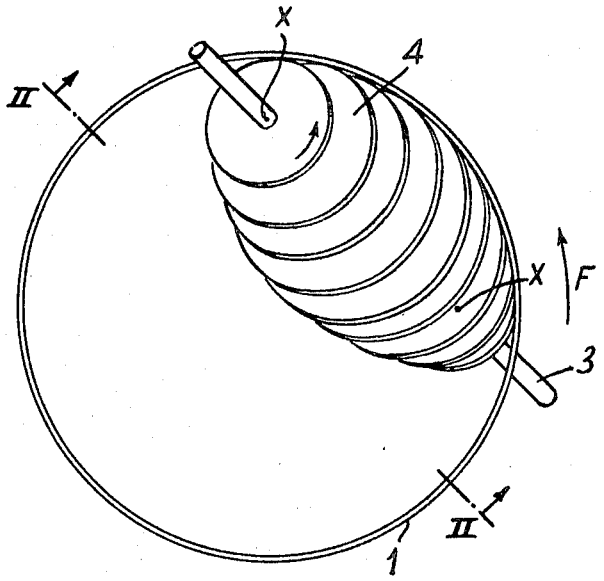
FIG. 1 is an end view of the drum with the advancing members formed by radial discs.
Figure 2:
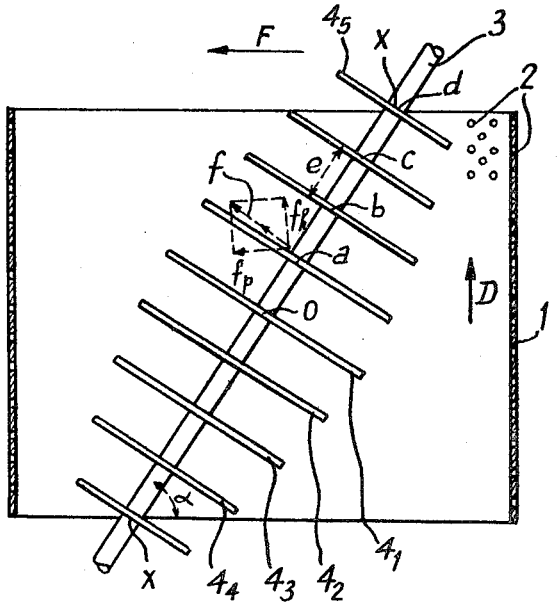
FIG. 2 is a sectional view of the hydro-extractor along line II—II of FIG. 1.

The hydro-extractor comprises, in the various embodiments, a perforated wall of revolution 1 which is shown as a cylindrical wall, driven in rotation in known manner about its axis so that the centrifugal force exerted on the material applied against the wall is several times higher than the force of gravity. Reference numeral 2 designates the perforations of which only a small number is shown.

Figure 3:
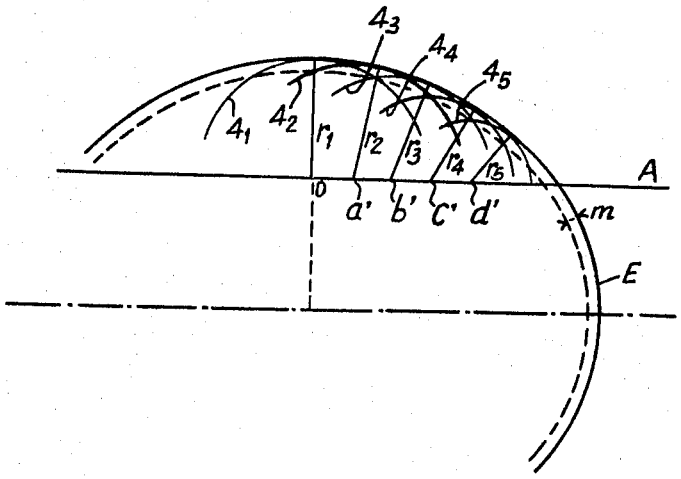
FIG. 3 is a geometrical construction provided for determining the radii of the discs forming the advancing members and the angular development of their region of action.
Figure 4:
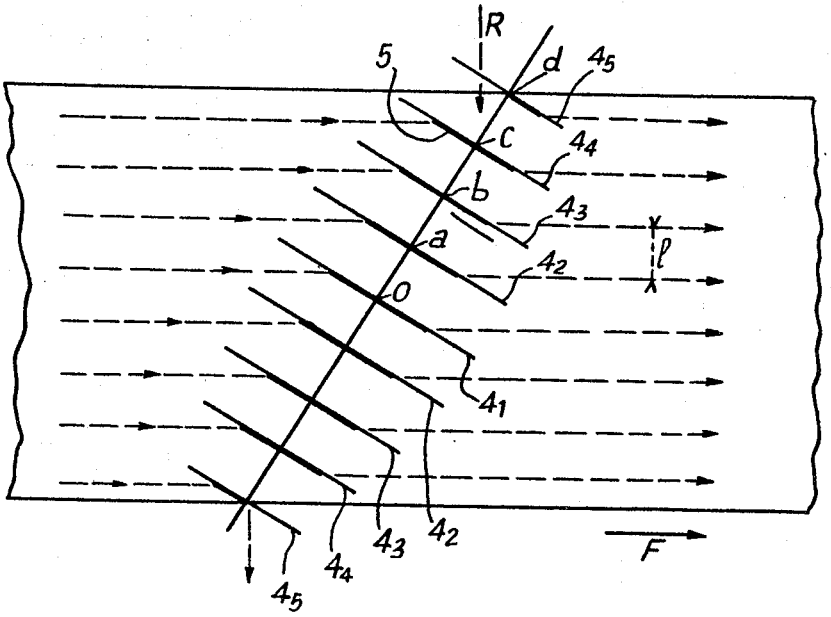
FIG. 4 is a developed plan view of the drum for explaining the mode of operation of the advancing members.

In this enclosure and in the embodiment of FIGS. 1–4, a shaft 3 is mounted obliquely via bearings which are not shown. In the embodiment illustrated, the points X where shaft 3 intersects the drum end surfaces are at an equal distance from said surface. On said shaft are mounted discs 4 for which could be substituted radial rods, pallets or the like according to the nature of the material to be dried. The diameters of said discs 4 or the length of the rods or the like are such that their peripheral end is substantially tangent to the inner surface of the wall 1. As shown in FIG. 3, the section of said surface by the planes through which move the parallel discs is, if points X are at equal distances from the surface, an ellipse the smaller axis of which is equal to the diameter of the drum and the greater axis of which is equal to the same diameter multiplied by $1/\sin \alpha$, $\alpha$ being the angle between shaft 3 and the drum axis. On said ellipse E (FIG. 3) is transfered the trace A of the axis of shaft 3 which is at a distance $r_1$ from the top of the small axis of the ellipse, said distance $r_1$ and the angle $\alpha$ defining the position of the shaft inside the drum. On the straight line A are transferred, from the center O corresponding to the center of the disc 41 of radius $r_1$, distances equal to $e/\tan \alpha$; e being the spacing between two discs. This provides points a', b', c', d' corresponding to the positions of points a, b, c, d which are the centers of the discs on the ellipse formed by the intersection of wall 1 with the plane of the disc. The smallest distance of each from said points to the ellipse corresponds to the disc radius tangent to the inner surface of the wall, respectively $r_2$, $r_3$, $r_4$ and $r_5$. If the thickness of the material layer to be dried is equal to m, the angular development according to which each disc will cooperate with the material is determined. In FIG. 4 are shown the discs with the portion cooperating with the material shown as a thicker line 5. The peripheral speed of the inner surface of wall 1 being equal to F, the discs are driven or have a tendency to assume, if they are mounted free in rotation about axis 3, or if the latter is mounted free in rotation, and under the effect of the thrust exerted by the material, a peripheral speed f which, at the tangential point with the wall, has a speed component $f_p$ substantially equal to F and a longitudinal component f1 in the downstream direction. In fact and as shown in FIG. 4, the material which has been introduced according to arrow R comes successively in contact with the upstream end of portion 5 of the successive discs, is moved in contact with the disc and is pushed downstream by being displaced, at each passage in front of the advance elements, by a certain distance.

Figure 5:
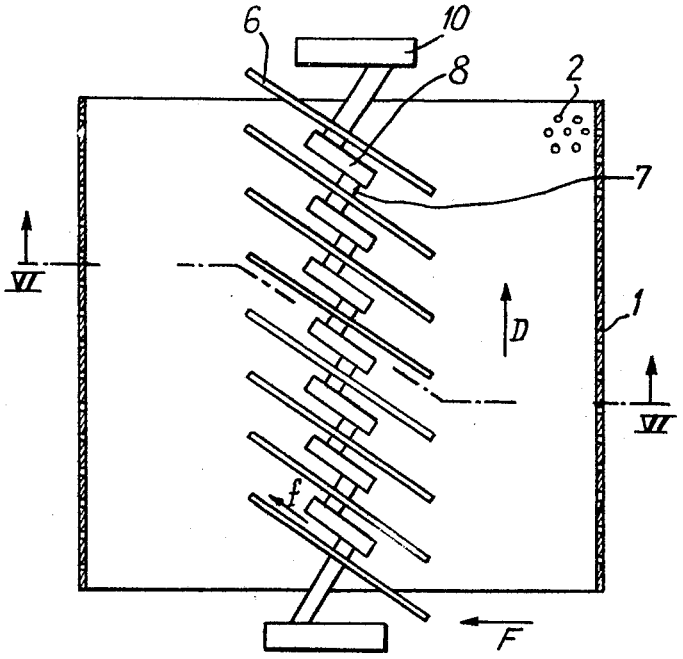
FIG. 5 is a view corresponding to FIG. 2 of another embodiment of the hydro-extractor.
Figure 6:
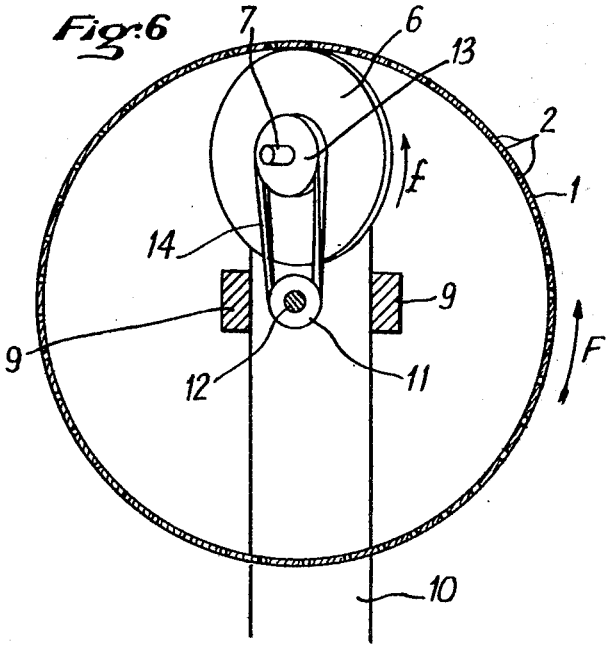
FIG. 6 is a sectional view along line VI—VI of FIG. 5.

In the embodiment of FIGS. 5 and 6, the discs 6 for which could be substituted radial rods, flat foam cylinders, bladed wheels, the peripheral edges of the blades being shaped as a drum, endless screws of same envelope, etc., are mounted each on a shaft-stub 7, the successive shaft-stubs being united by off-setting pieces 8 and being all of the same orientation, being therefore in the same plane. The discs 6 are therefore carried by the parallel axes of a staggered support piece. The mechanical rigidity of the support piece can be the result either of the rigid assembly between pieces 8 and shaft-stubs 7 on which the discs 6 are mounted free in rotation, or of the fact that pieces 8 are supported by bracings not shown and connecting them, by passing between discs 6, with longitudinal crosspieces 9 fixed at their ends on the support pillars 10. The discs 6 can be driven in rotation for example for each disc from a pulley 11 mounted on an axial shaft 12, via a pulley 13 rigidly connected thereto and a belt 14. Thus, one can control the peripheral speed f on each disc by acting on the diameter of pulley 11, this being possibly of technical interest. It could also be possible to mount the advancing elements free in rotation. Finally, it is possible to modify the nature of the advancing elements according to the progression direction of the material in order to adapt them to the fluidity and density variations of the dry material and some of them can be blowing and/or heating elements.

In the embodiment of FIG. 5, there is provided a single disc for each shaft-stub 7, but it is obvious that the two embodiments can be combined.

What is claimed is:

1. A continuously operating hydro-extractor with a perforated wall which is a figure of revolution driven in rotation about its axis so that a layer of material collects on the wall, comprising advancing members acting on the material layer to advance the material layer in a downstream direction, the path of travel of any one point on the advancing members in the region where said members cooperate with the material layer on the perforated wall comprising a component in the diametrial plane and an axial component in said downstream direction.

2. A continuously operating hydro-extractor according to claim 1, wherein the advancing members are made of radial elements rigidly connected to a shaft rotatably mounted in the inner volume defined by said wall, the length of each radial element being slightly less than the shortest distance from the shaft to said wall, said shaft being disposed at an acute angle to said axis.

3. A continuously operating hydro-extractor according to claim 2, wherein the shaft and/or the advancing members are mounted free in rotation.

4. A continuously operating hydro-extractor according to claim 2, wherein said shaft is driven in rotation, the shaft direction of rotation and speed being such that, in the portion of their circular path of travel where they move in the vicinity of the wall, the ends of the radial elements move in the downstream direction, their peripheral speed being at least about as great as the peripheral speed of the inner surface of the perforated wall.

5. A continuously operating hydro-extractor according to claim 1, wherein the advancing members are elements mounted free in rotation about shaft-stubs rigidly connected for forming a staggered shaft, the general line of the shaft being parallel to the drum generatrix.

6. A continuously operating hydro-extractor according to claim 5, wherein the advancing members are mounted free in rotation.

7. A continuously operating hydro-extractor according to claim 5, wherein the advancing members are driven in rotation.

8. A continuously operating hydro-extractor according to claim 2, wherein the oblique shaft has its two ends at a distance from the perforated wall proportional to the radius of said perforated wall in the corresponding diametral plane and the downstream end is off-set in the upstream direction relative to the rotation direction of the perforated wall.

9. A continuously operating hydro-extractor according to claim 2, wherein the downstream end of the oblique shaft is at a distance from the perforated wall proportionally greater than that of the upstream end.

10. A continuously operating hydro-extractor according to claim 1, wherein the advancing members are spaced rotatable disks that are parallel to each other and that lie in planes disposed at an acute angle to said axis.

* * * * *